US005891616A

United States Patent [19]

Gilliams et al.

[11] Patent Number: 5,891,616

[45] Date of Patent: Apr. 6, 1999

[54] PROCESS FOR PRODUCING A SUSPENSION OF PARTICLES CONTAINING AN ORGANIC SILVER SALT FOR USE IN THE PRODUCTION OF THERMOGRAPHIC AND PHOTOTHERMOGRAPHIC MATERIALS

[75] Inventors: Yvan Gilliams, Hever; Herman Uytterhoeven, Bonheiden, both of Belgium

[73] Assignee: Agfa-Gevaert, Mortsel, Belgium

Related U.S. Application Data

[60] Provisional application No. 60/003,753, Sep. 14, 1995.

[21] Appl. No.: 683,615

[22] Filed: Jul. 17, 1996

[30] Foreign Application Priority Data

Jul. 18, 1995 [EP] European Pat. Off. ..... 95201968

[51] Int. Cl.[6] ..... G03C 1/00

[52] U.S. Cl. ..... 430/617; 430/619; 430/620

[58] Field of Search ..... 430/617, 619, 430/569, 620

[56] References Cited

U.S. PATENT DOCUMENTS

| | | | |
|---|---|---|---|
| 3,458,544 | 7/1969 | Bryan . | |
| 4,157,289 | 6/1979 | Ikenoue et al. | 204/195 |
| 4,273,723 | 6/1981 | Hayashi et al. | 260/414 |
| 4,291,120 | 9/1981 | Kobayashi et al. | 430/620 |
| 4,784,939 | 11/1988 | Van Pham | 430/607 |
| 5,264,334 | 11/1993 | Przezdziecki et al. | 430/620 |

FOREIGN PATENT DOCUMENTS 1378734 12/1974 United Kingdom .

*Primary Examiner*—Thorl Chea
*Attorney, Agent, or Firm*—Baker & Botts, L.L.P.

[57] ABSTRACT

A process for producing a suspension of particles containing a substantially light-insensitive organic silver salt of an organic carboxylic acid, comprising simultaneous metered addition of an aqueous solution or suspension of an organic carboxylic acid or its salt; and an aqueous solution of a silver salt to an aqueous liquid, wherein the metered addition of the aqueous solution or suspension of the organic carboxylic acid or its salt; and/or the aqueous solution of the silver salt is regulated by the concentration of silver ions or the concentration of anions of the silver salt in the aqueous liquid; for use in the production of (photo)thermographic materials.

12 Claims, 3 Drawing Sheets

PROCESS FOR PRODUCING A SUSPENSION OF PARTICLES CONTAINING AN ORGANIC SILVER SALT FOR USE IN THE PRODUCTION OF THERMOGRAPHIC AND PHOTOTHERMOGRAPHIC MATERIALS

This application claims the benefit of U.S. Provisional Application Ser. No. 60/003, 753 filed Sep. 14, 1995.

FIELD OF THE INVENTION

The present invention relates to a process for producing a suspension of particles containing an organic silver salt for use in the production of thermographic and photothermographic materials.

BACKGROUND OF THE INVENTION

Thermal imaging or thermography is a recording process wherein images are generated by the use of thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element.

3. Thermal dye transfer printing wherein a visible image pattern is formed by transfer of a coloured species from an imagewise heated donor element onto a receptor element.

Thermographic materials of type 1 can be rendered photothermographic by incorporating a photosensitive agent which after exposure to UV, visible or IR light is capable of catalyzing or participating in a thermographic process bringing about changes in colour or optical density.

Thermal dye transfer printing is a recording method wherein a dye-donor element is used that is provided with a dye layer wherefrom dyed portions or incorporated dyes are transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially light-insensitive, but are sensitive to heat or thermographic.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reductor.

According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas-of an original as illustrated in FIGS. 1 and 2 of U.S. Pat. No. 3,074,809.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over said sheet, and as the image forming component an oxidation-reduction reaction combination which is substantially latent under ambient conditions and which can be initiated into reaction by said free metal to produce a visible change in colour comprising an organic silver salt containing carbon atoms and different from said heavy metal salt as an oxidizing agent and in addition an organic reducing agent containing carbon atoms, said radiation-sensitive heavy metal salt being present in an amount between about 50 and about 1000 parts per million of said oxidation-reduction reduction reaction combination.

Various methods of preparing substantially light-insensitive organic silver salts for use in such thermographic and photothermographic materials, as described in, for example, U.S. Pat. No. 2,910,377, U.S. Pat. No. 3,031,329, U.S. Pat. No. 3,458,544, U.S. Pat. No. 3,700,458, U.S. Pat. No. 3,960,908, U.S. Pat. No. 3,960,980, U.S. Pat. No. 4,193,804, U.S. Pat. No. 4,476,220, U.S. Pat. No. 3,839,049 and in Research Disclosure 17029 published in June 1978 and in references therein. A typical preparation process for the silver salts of fatty acids is described by D. Kloosterboer in "Imaging Processes and Materials, Neblette's 8th edition", edited by J. Sturge, V. Walworth and A. Shepp, page 279, Van Nostrand (1989) in which: "fatty acids are dispersed in water concentrations of 2 to 3%; heated above the titre point of the fatty acid (to about 80° C.). With high speed stirring, the amount of sodium hydroxide equivalent to the desired percentage of silver soap is added. Silver nitrate is then added (to the whole quantity of sodium soap) to convert the sodium soap to the silver soap. During the silver addition the material forms a micelle with the hydrocarbon tail extended into the centre of the micelle. After the addition of the silver nitrate the solution may be filtered either hot or after cooling. The filtered solid is then dried until no further weight loss at about 50° C. During drying the micelles collapse to form thin micelles approximately 1 $\mu$m long, 0.1 $\mu$m wide and 0.015 $\mu$m thick". Such organic silver salts can also be produced by adding a silver salt, such as ammoniacal silver nitrate, silver trifluoroacetate, silver tetrafluoroborate, or silver oxide to a solution or dispersion of an organic compound with at least one ionizable hydrogen atom.

U.S. Pat. No. 3,458,544 describes a process for preparing water insoluble silver salt which comprises admixing a water immiscible phase containing an organic carboxylic acid dissolved therein, the silver salt of which is water insoluble, and an aqueous phase containing an alkali soluble silver complex having a dissociation constant higher than the silver salt of said organic acid, the pH of said aqueous phase being at least about 7.5, and recovering precipitated water insoluble silver salt of said organic carboxylic acid. The water insoluble silver salt forms as a precipitate at the interface of the two immiscible phases and is recovered, usually by settling, filtration, washing with distilled water to remove undesired anions and drying to produce a fine, free flowing powder having a high surface area and a high degree of purity.

GB-P 1,378,734 describes a process for producing a silver salt of an organic carboxylic acid having a grain size of less than 1 $\mu$m in diameter and a grain which is almost spherical, which comprises mixing: (a) an aqueous solution of a silver nitrate or a silver complex with (b) a solution of an organic carboxylic acid in a solvent in which the organic carboxylic acid is soluble, both said silver salt of an organic carboxylic acid and silver nitrate being almost insoluble and with which water is sparingly miscible, so as to react said carboxylic acid with silver ions, the reaction being conducted in the presence of a soluble mercury compound and/or a soluble lead compound. According to example 12 of this patent, photothermographic materials with a silver coating weight of 1.0 g/m$^2$, utilizing 0.3 $\mu$m spherical grains of silver behenate particles obtained in the presence of mercuric nitrate, exhibited a transmittance of 85% at a wavelength of 500 nm.

In the prior art, substantially light-insensitive organic silver salts are produced by the addition of a silver salt or complex to an organic compound with an ionizable hydrogen atom, or its salt, such that initially a large excess of said acidic organic compound or its salt is present. The precipitation of such highly insoluble organic silver salts under such conditions makes the control of particle size and the avoidance of occluded acidic organic compound, or its salt, very difficult. Furthermore, particle agglomeration takes place, whether or not the particles are separated off and dried. Many properties of thermographic materials using said salts, are directly or indirectly dependent upon their particle size, e.g. light-insensitivity, storage properties, resolution, transparency and quantity of organic silver salt per unit area necessary to obtain the required maximum image density. Particle size is therefore important both as regards the economics of the production process and as regards the imaging properties of the thermographic or photothermographic material obtained with said particles.

Another important element in determining the imaging properties of such thermographic and photothermographic materials is the shape and morphology of the substantially light-insensitive organic silver salt-containing particles. With the exception of the process described in GB-P 1,378,734, the prior art processes for producing such organic silver salt particles or their suspensions produce needle-shaped particles such as, for example, silver behenate particles with a length of 1 $\mu$m, a width of 0.1 $\mu$m and a thickness of 0.01 $\mu$m, as described by D. A. Morgan in "Handbook of Imaging Science", edited by A. R. Diamond, page 43, published by Marcel Dekker in 1991. Coating of dispersions of such needle-shaped particles using conventional techniques will produce alignment of such needles parallel to the coating direction resulting in material anisotropy, which will have an adverse effect on the imaging properties of such thermographic and photothermographic materials, particularly in the case of high resolution applications.

The incorporation of such ecologically suspect ions as mercury and lead ions into the organic silver salt particles, poses ecological problems in the disposal of such materials and of waste arising during the production process; and the handling thereof.

A still further important element in determining the imaging properties of such thermographic and photothermographic materials is the composition of the substantially light-insensitive organic silver salt-containing particles. With the single jet processes described in the prior art, a precise control over the microstructure of said particles is not possible when more than one molecular species is present in said particle.

The production economics of prior art thermographic and photothermographic materials are disadvantaged by the prior art production process for substantially light-insensitive organic silver salt grains and mixtures of substantially organic silver salt and photosensitive agent having to be carried out in several steps which can not be executed in a single reactor.

OBJECTS OF THE INVENTION

It is a first object of the invention to improve the production economics of thermographic and photothermographic materials by enabling the production of particle suspensions containing a photosensitive agent and/or a substantially light-insensitive organic silver salt in a single reactor.

It is a further object of the invention to provide a process in which a suspension of substantially light-insensitive organic silver salt containing particles, which can be used in the production of thermographic and photothermographic materials without isolating said particles.

It is an even further object of the invention to provide a process for producing a suspension of particles containing a photosensitive agent and/or a light-insensitive organic silver salt.

It is an even further object of the invention to provide a process for producing a suspension of substantially light-insensitive organic silver salt containing particles with a better defined composition, a particular shape, a particular morphology and with a narrow particle size distribution.

It is a still further object of the invention to provide a process in which the aggregation of substantially light-insensitive organic salt containing particles is reduced.

It is a still further object of the invention to provide a material in which said substantially light-insensitive organic silver salt containing particles are isotropically distributed in said material.

Further objects and advantages of the invention will become apparent from the description hereinafter.

SUMMARY OF THE INVENTION

According to the present invention a process is provided for producing a suspension of particles containing a substantially light-insensitive silver salt of an organic carboxylic acid, comprising simultaneous metered addition of an aqueous solution or suspension of an organic carboxylic acid or its salt; and an aqueous solution of a silver salt to an aqueous liquid, wherein the metered addition of the aqueous solution or suspension of the organic carboxylic acid or its salt; and/or the aqueous solution of the silver salt is regulated by the concentration of silver ions or the concentration of anions of said silver salt in the aqueous liquid.

Preferably the organic carboxylic acid is a fatty acid and the salt of an organic carboxylic acid is a salt of a fatty acid, particularly a salt of behenic acid.

According to the present invention a material is provided comprising particles containing a substantially light-insensitive silver salt of an organic carboxylic acid produced using the process.

Preferably the substantially light-insensitive silver salt of an organic carboxylic acid is a silver salt of a fatty acid, most preferably silver behenate.

Preferred embodiments of the present invention are disclosed in the detailed description of the invention.

DETAILED DESCRIPTION OF THE INVENTION

It has been established that thermographic and photothermographic materials produced using the aqueous suspensions of particles containing a substantially light-insensitive silver salt of an organic carboxylic acid obtained by varying the production conditions, such as the presence of free silver ions, dispersing agents etc. in the suspending aqueous liquid, as provided by the process for producing an aqueous suspension of particles containing a substantially light-insensitive silver salt of an organic carboxylic acid, of the present invention, comprising the simultaneous metered addition of an aqueous solution or a suspension of an organic carboxylic acid or its salt; and an aqueous solution of a silver salt to an aqueous liquid, exhibit a surprising improvement in properties, e.g. transparency, over such materials produced using prior art suspensions of said particles.

Figure 1:
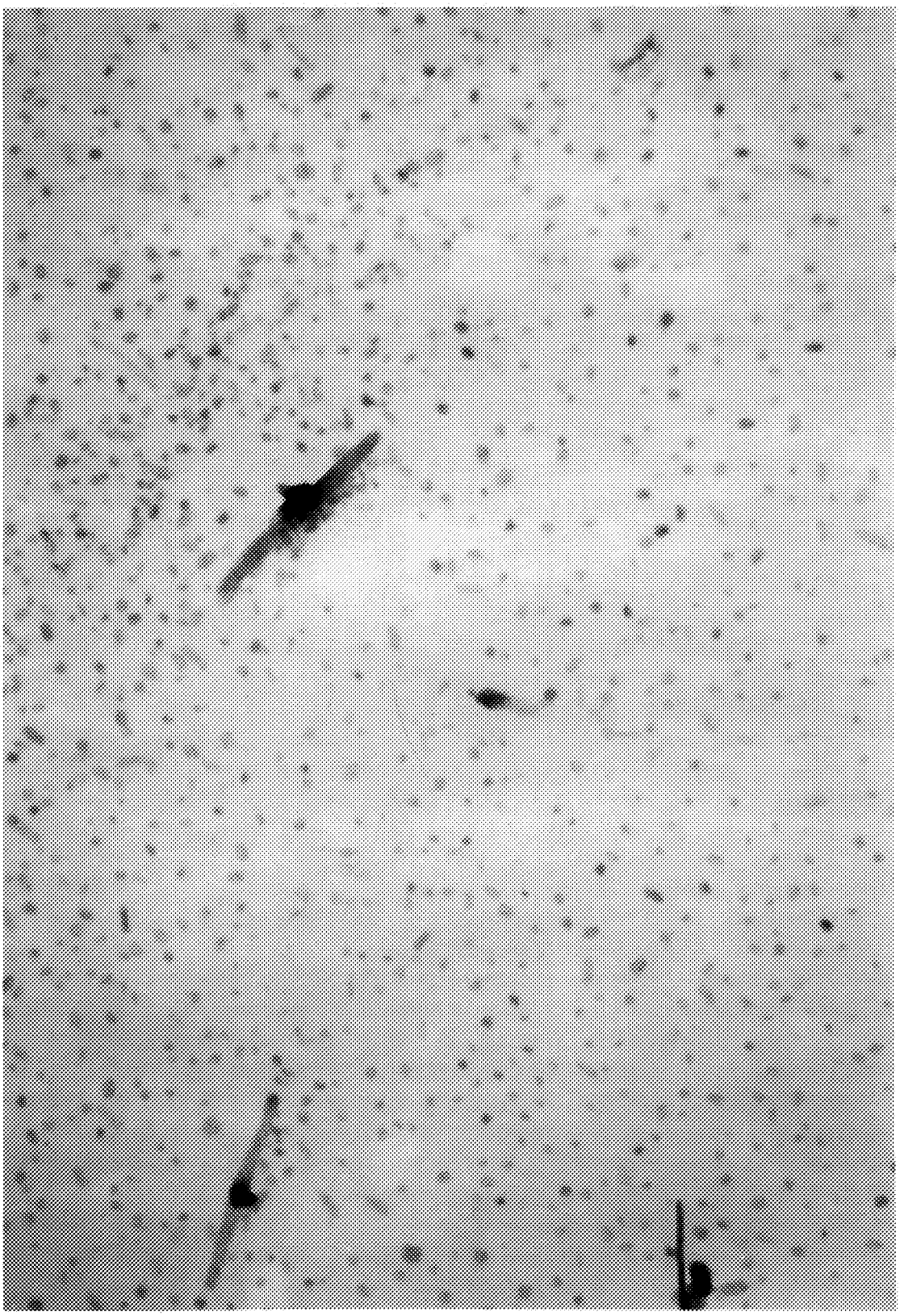
Figure 2:
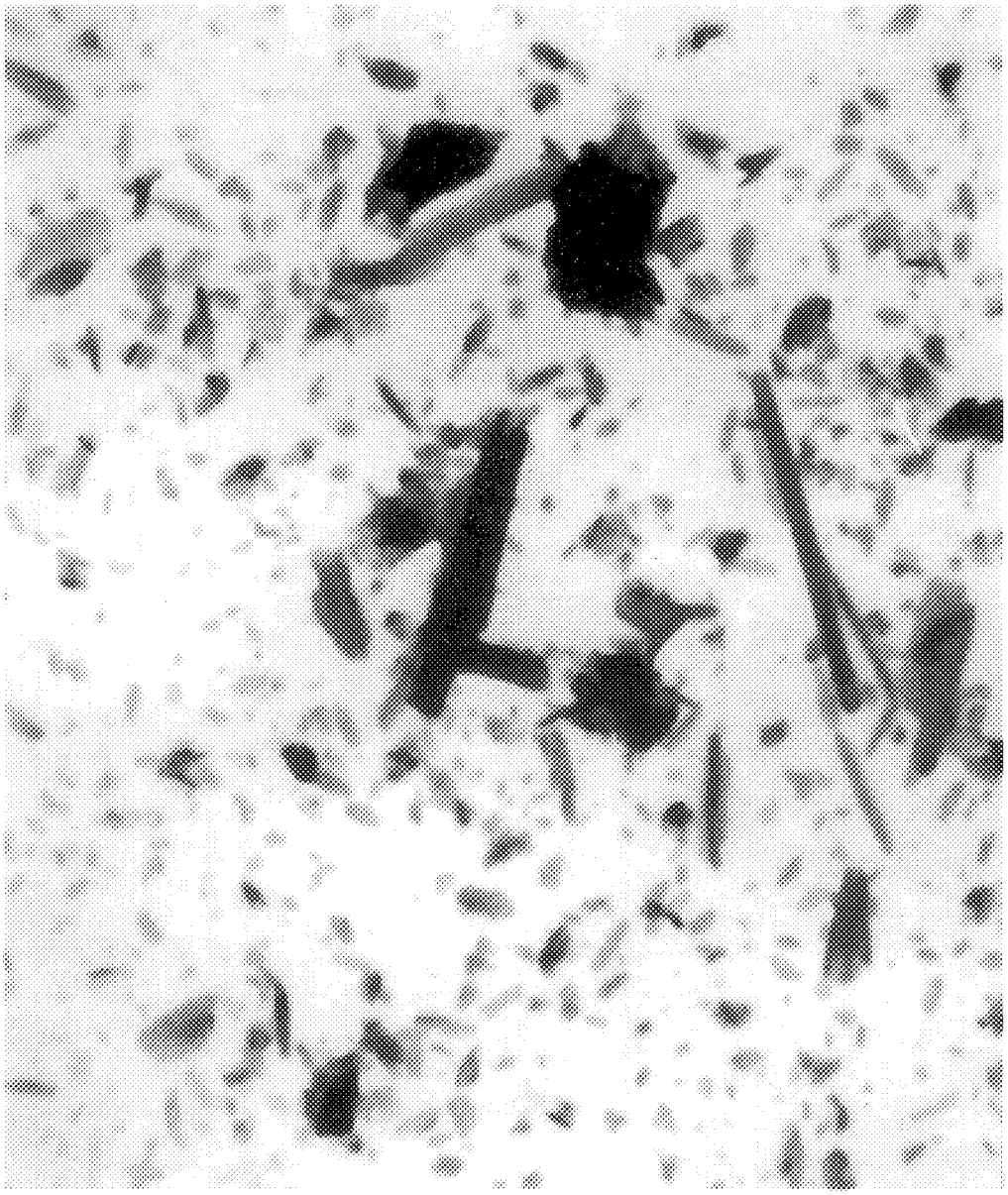
Figure 3:
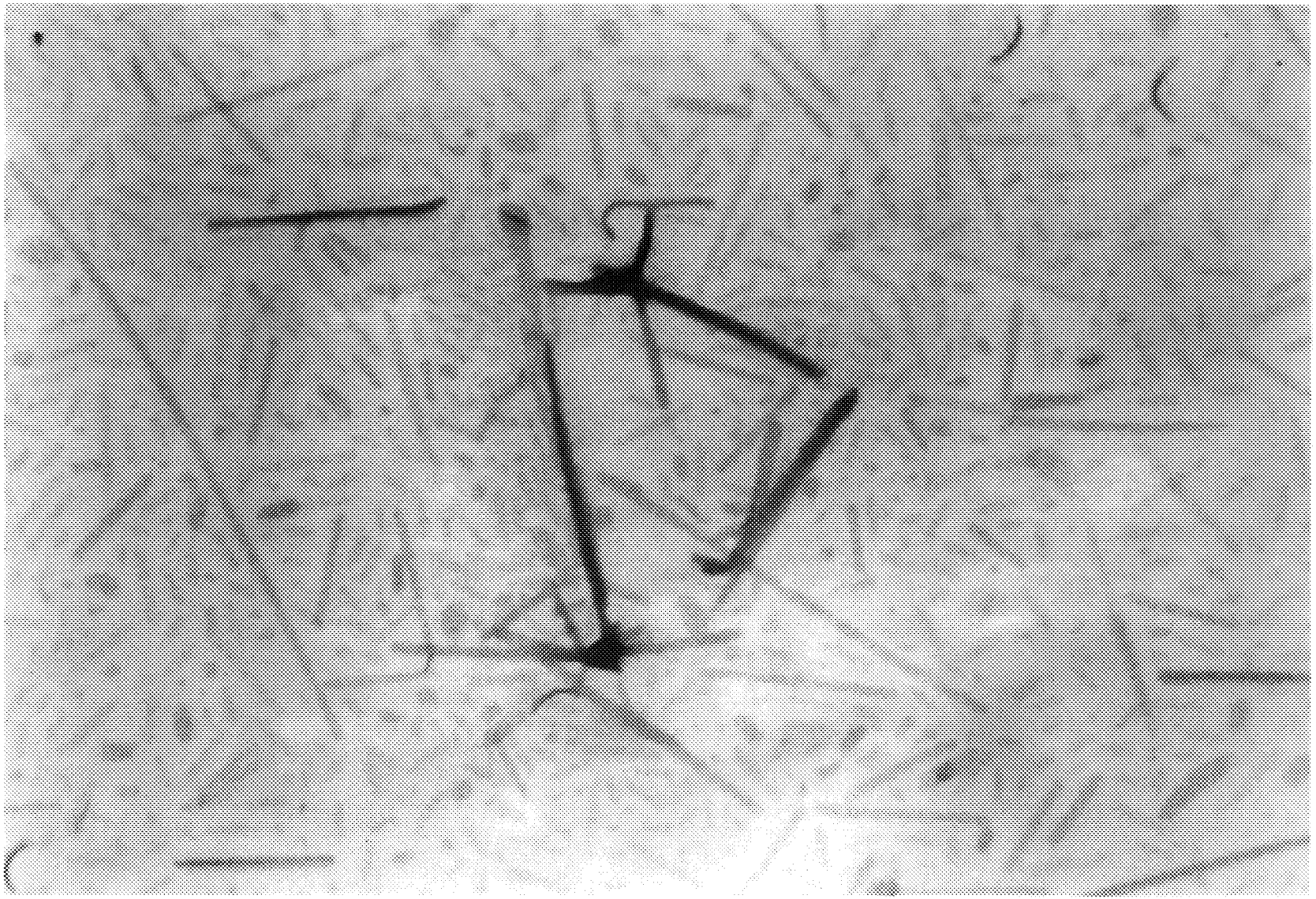

Transmission electron micrographs of the dispersions of particles obtained in INVENTION EXAMPLES 1, COMPARATIVE EXAMPLE 1 and INVENTION EXAMPLE 8 are shown in FIGS. 1, 2 and 3 respectively. The magnification in the photographs of FIGS. 1 and 3 is 50,000× (1 cm=200 nm) and that of FIG. 2 is 30,000× (1 cm=333 nm).

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc; glycols e.g. ethylene glycol; glycerine; N-methyl pyrrolidone; methoxypropanol; and ketones e.g. 2-propanone and 2-butanone etc.

Production of Particles of Silver Salts of Organic Carboxylic Acids

According to the present invention a process is provided for producing a suspension of particles containing a substantially light-insensitive silver salt of an organic carboxylic acid, comprising simultaneous metered addition of an aqueous solution or suspension of an organic carboxylic acid or its salt; and an aqueous solution of a silver salt to an aqueous liquid, wherein the metered addition of the aqueous solution or suspension of the organic carboxylic acid or its salt; and/or the aqueous solution of the silver salt is regulated by the concentration of silver ions or the concentration of anions of said silver salt in the aqueous liquid. The concentration of silver ions or the concentration of anions of the silver salt in the aqueous liquid on which the metered addition is based may, according to the present invention, vary during the course of the production process depending upon the required characteristics of the particles.

The temperatures of the aqueous solution or suspension of the organic. carboxylic acid or its salt; the aqueous solution of the silver salt; and the aqueous liquid are determined by the required characteristics of the particles; and may be kept constant or may be varied during the synthesis of the organic silver salt of an organic carboxylic acid again depending upon the required characteristics of said particles.

The metered addition of the aqueous solution or suspension of the organic carboxylic acid or its salt; and/or said aqueous silver salt solution to the suspending aqueous liquid, according to the present invention, may be regulated such that an excess of silver ions is present in said liquid during said production of the particles.

In a further embodiment, according to the present invention, the regulated excess of silver ions during the production of the particles may be achieved by maintaining the UAg of the aqueous liquid, defined as the potential difference between a silver electrode (of ≧99.99% purity) in the aqueous liquid and a reference electrode consisting of a Ag/AgCl-electrode in 3M KCl solution at room temperature connected with said liquid via a salt bridge consisting of a 10% $KNO_3$ salt solution, at 70° C. at at least 380 mV.

As the UAg at which the suspension of particles containing a substantially light-insensitive salt of an organic carboxylic acid is produced is increased above 380 mV, the particles become smaller and less needle-shaped eventually having no preferred growth direction, as can be seen by comparing FIG. 1 (UAg=400 mV) with FIG. 3 (UAg=380 mV).

In further embodiments of the above described process the UAg is such that 80% of the particles containing a substantially light-insensitive silver salt of an organic carboxylic acid are produced with no preferred growth direction and the UAg is such that 90% of the particles have a diameter ≦60 nm.

A process according to the present process is also provided, wherein the pH of the suspension is regulated during the production of the substantially light-insensitive particles of the silver salt of an organic carboxylic acid by adding an acidic or alkaline solution via an additional jet.

A process according to the present invention is also provided further comprising the step of removing soluble salts produced during the process and any excess dissolved ions by on-line or off-line desalting, such as dialysis or ultrafiltration processes. Desalting of the aqueous suspension may be achieved after completion of the production process by precipitation of the suspension, followed by decantation, washing and redispersion.

Furthermore, the suspending medium may be changed from a hydrophilic to a hydrophobic suspending medium at the end of the production process.

A process according to the present invention may be carried out batchwise or in continuous mode in any suitable recipient.

The particles containing a substantially light-insensitive silver salt of an organic carboxylic acid, of the present invention, may contain several molecular species, such as: substantially light-insensitive organic heavy metal salts; photosensitive agents; organic compounds e.g. fatty acids, dicarboxylic acids etc.; salts of organic compounds e.g. salts of fatty acids; stabilizers: antifoggants etc., said molecular species being randomly distributed in said particles or incorporated in a predetermined microstructure. Said particles may also be used in mixtures with light-insensitive organic silver salt of an organic carboxylic acid-containing particles prepared using prior art technology.

Dispersing Agent

The aqueous liquid for suspending the particles, according to the present invention, may contain a dispersing agent for the particles. The dispersing agent is, according to the present invention, preferably selected from the group consisting of a natural polymeric substance, a synthetic polymeric substance and a finely divided powder. Suitable hydrophilic natural or synthetic polymeric substances contain one or more hydroxyl, carboxyl, sulfonate, sulfate, phosphate, ethylene oxide or propylene oxide groups. Examples of suitable hydrophilic natural polymers are protein-type binders such as gelatin, casein, collagen, albumin and modified gelatin e.g. acetylated or phthaloyl gelatin; modified cellulose, e.g. hydroxyethylcellulose, cellulose acetate-butyrate and cellulose acetate-propionate; starch; modified starch; modified sugars; modified dextrans etc. Examples of suitable hydrophilic synthetic polymeric substances are polyalkylene oxides; polyacetals, such as polyvinylbutyral; polyvinylalcohol; polyvinylpyrrolidone; polyacrylic acid; and polymethacrylic acid and their copolymers and salts thereof.

The dispersing agent may also be a finely divided non-metallic inorganic powder such as silica.

Such dispersing agents may also be present in the aqueous solution or suspension of the organic carboxylic acid or its salt; and in the aqueous solution of the silver salt; may be added via an additional jet during the production process of the aqueous suspension of particles containing a substantially light-insensitive silver salt of an organic carboxylic acid; and may be added at the end of the production process.

Conversion of Excess Silver Ions into Silver Salts

A process according to the present invention is also provided, wherein after completion of said production of the aqueous suspension, excess dissolved silver ions are converted into at least one silver salt. The silver salt may, according to the present invention, be organic or inorganic, substantially light-insensitive or photosensitive. If photosensitive, it may, after exposure (as is the case with silver halide), be capable of catalyzing the thermal reduction of the silver ions of the light-insensitive silver salt of an organic carboxylic acid to metallic silver with an organic reducing agent. Agents used for converting the excess dissolved silver ions into a silver salt may be organic compounds with at least one ionizable hydrogen atom, or their salts; or inorganic halides, such as metallic halides e.g. KBr, KI, $CaBr_2$, $CaI_2$ etc.; or ammonium halides. If inorganic halides are used silver halide is produced "in-situ", thereby rendering the aqueous suspension photosensitive.

The inorganic halides may also convert part of the substantially light-insensitive silver salt of an organic carboxylic acid "in-situ" into silver halide, thereby rendering the suspension photosensitive.

Thermographic Material

According to a preferred embodiment of the present invention, a thermographic recording material consisting of at least one element is provided comprising particles, produced according to the present invention, an organic reducing agent for the particles in thermal working relationship with the particles and a film-forming polymeric binder.

Thermographic materials consisting of more than one element may have at least one ingredient necessary for thermal development applied imagewise followed by uniform heating of receptor elements, such as described in EP-A 641 669 and EP-A 706 094, or at least one ingedient may be transferred from a donor element in contact with a receptor element during image-wise heating of said receptor element as in so-called reducing agent transfer printing (RTP) as described in EP-A 671 283.

Photothermographic Material

In another preferred embodiment of the present invention, a photothermographic recording material is provided comprising particles produced according to the present invention, an organic reducing agent for the particles in thermal working relationship with the particles, a film-forming polymeric binder and a photosensitive agent, or a component capable of forming a photosensitive agent with the particles, capable after exposure of catalyzing the thermal reduction of the particles to metallic silver with the organic reducing agent.

In particularly preferred embodiments of the photothermographic recording material the photosensitive agent is silver halide and the component capable of forming a photosensitive agent with the particles has a negatively ionizable halogen atom, such as ionizable organohalo-compounds, e.g. N-bromosuccinimide; and inorganic halides, e.g. metallic and ammonium halides.

Silver Salts of Organic Carboxylic Acids

Preferred substantially light-insensitive silver salts of organic carboxylic acids produced using the process according to the present invention and used in the thermographic and photothermographic materials, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image.

Organic Reducing Agents

Suitable organic reducing agents for the reduction of the substantially light-insensitive silver salt of an organic carboxylic acids are organic compounds containing at least one active hydrogen atom linked to O, N or C, such as is the case with: catechol; hydroquinone; aminophenols; METOL (tradename); p-phenylenediamines; alkoxynaphthols, e.g. 4-methoxy-1-naphthol described in U.S. Pat. No. 3,094,41: pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

During the thermal development process the reducing agent must be present in such a way that it is able to diffuse to the substantially light-insensitive silver salt of an organic carboxylic acid particles so that reduction of the substantially light-insensitive silver salt of an organic carboxylic acid can take place.

Auxiliary Reducing Agents

The above mentioned reducing agents, regarded as primary or main reducing agents, may be used in conjunction with so-called auxiliary reducing agents. Such auxiliary reducing agents are e.g. sterically hindered phenols, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula:

Aryl-$SO_2$—NH-Arylene—OH in which:

Aryl represents a monovalent aromatic group, and

Arylene represents a bivalent aromatic group, having the —OH group preferably in para-position to the —$SO_2$—NH— group;

as described in Research Disclosure 17842 published in February 1979, U.S. Pat. No. 4,360,581, U.S. Pat. No. 4,782,004, and in EP-A 423 891.

Other auxiliary reducing agents that may be used in conjunction with the above mentioned primary reducing agents are organic reducing metal salts, e.g. stannous stearate described in U.S. Pat. No. 3,460,946 and 3,547,648.

Photosensitive Agents

Photosensitive agents capable of rendering said thermographic materials photothermographic i.e. being able upon exposure of forming a species capable of catalyzing the reduction of the silver ions of said organic silver salt of an organic carboxylic acid to silver by a reducing agent in thermal working relationship therewith upon the application of heat, should be in intimate contact with said organic silver salt of an organic carboxylic acid. This can be achieved by producing said photosensitive agent "ex situ" and then adding it to said organic silver salt of an organic carboxylic acid or "in situ" by preparing said photosensitive agent in the presence of said organic silver salt of an organic carboxylic acid. Suitable photosensitive agents therefor are heavy metal organic or inorganic salts, preferably of a Group 1b metal of the Periodic Table, with metal diazo-sulfonate salts; salts of a hydrogen halide, such as chloride, bromide or iodide; or salts of nitric or sulfinic acid being preferred. Suitable metals include silver, copper, chromium, cobalt, platinum and gold; with silver being preferred. Mixtures of the above may also be used.

A simple test, which may be used to determine whether or not a particular metal salt can photogenerate a catalyst (free metal) for the reducing of the silver oxidizing agent with the reducing agent, is described in U.S. Pat. No. 3,152,904. First a freshly prepared sample of the metal salt in question (50 mg) is admixed with an aqueous or alcoholic suspension or dispersion (5 ml) of silver behenate (0.5 g). This dispersion is coated on filter paper and dried. The coated paper is then overcoated with aqueous or alcoholic solution of a 0.5% aqueous or alcoholic solution (5 ml) of a reducing agent, preferably hydroquinone and again dried. No immediate reaction should take place in the absence of light. This coated filter paper is then exposed to light (about 5–10 s with RS sun lamps—6 inches' distance) and heated to about 90°–100° C. for 5 s. If the exposed paper darkens more rapidly than a similar paper sample under the same conditions without the metal salt, the salt is suitable as a photosensitive generator of a catalyst.

In a further embodiment, according to the present invention, production of the aqueous suspension of particles containing a substantially light-insensitive silver salt of an organic carboxylic acid is immediately followed by the production of silver halide "in-situ" in the same recipient, thereby producing a photosensitive suspension.

The suspension of particles containing a substantially light-insensitive organic silver salt of an organic carboxylic acid may, according to the present invention, also be produced in the presence of silver halide.

Spectral Sensitizers

The photosensitive agent may be spectrally sensitized in the visible spectrum and in the IR-range of the spectrum with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. The sensitizing power of said spectral sensitizers may be augmented by the use of so-called super-sensitizers such as described, for example for IR-spectral sensitizers in EP-A 559 228, U.S. Pat. No. 5,258,282 and JN63023145.

Antihalation Dyes

Thermographic materials rendered photosensitive by the presence of a photosensitive agent may contain antihalation or acutance dyes which absorbs light which has passed through the photosensitive layer, thereby preventing its reflection, such as described in U.S. Pat. No. 3,515,559, DE-P 1 927 412, U.S. Pat. No. 4,033,948, U.S. Pat. No. 4,197,131, EP-A 12 020, CA-P 1,139,149, U.S. Pat. No. 4,271,263, EP-B 101 646, EP-B 102 781, U.S. Pat. No. 4,752,559, EP-A 377 961, U.S. Pat. No. 5,300,420, EP-A 627 660, EP-A 652 473, U.S. Pat. No. 5,382,504 and U.S. Pat. No. 5,395,747.

Binders

The film-forming binder of the material containing the substantially light-insensitive silver salt of an organic carboxylic acid may be solvent soluble or solvent dispersible or may be water soluble or water dispersible.

Film-forming binders suitable for materials coated from solvent dispersions or solutions may be all kinds of natural, modified natural or synthetic resins or mixtures of such resins, wherein the organic heavy metal salt can be dispersed homogeneously or dissolved: e.g. polymers derived from α, β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

A particularly suitable solvent soluble binder is polyvinyl butyral containing a minor amount of vinyl alcohol units is marketed by MONSANTO, USA as BUTVAR™ B79 and BUTVAR™ B76 and provides a good adhesion to paper and properly subbed polyester supports.

Film-forming binders suitable for such materials are proteinaceous binders such as gelatin and gelatin derivatives e.g. phthaloloyl gelatin.

The binder to organic silver salt of an organic carboxylic acid weight ratio is preferably in the range of 0.2 to 6, and the thickness of the recording layer is preferably in the range of 1 to 50 $\mu$m.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

By-the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants, e.g. the reducing agent for the substantially light-insensitive organic silver salt of an organic carboxylic acid, at a temperature above 60° C. Useful for said purpose are the polyethylene glycols having a mean molecular weight in the range of 1,500 to 20,000 described in U.S. Pat. No. 3,347,675. Other suitable heat solvents are compounds such as urea, methyl sulfonamide and ethylene carbonate as described in U.S. Pat. No. 3,667,959; compounds such as tetrahydro-thiophene-1,1-dioxide, methyl anisate and 1,10-decanediol as described in Research Disclosure 15027 published in December 1976; and those described in U.S. Pat. No. 3,438,776, U.S. Pat. No. 4,740,446, U.S. Pat. No. 5,368,979, EP-A 0 119 615, EP-A 122 512 and DE-A 3 339 810.

Toning Agents

In order to obtain a neutral black image tone in the higher densities and neutral grey in the lower densities, thermographic and photothermographic materials according to the present invention may contain one or more toning agents. Said toning agents should be in thermal working relationship with said substantially light-insensitive organic silver salt of an organic carboxylic acids and reducing agents during thermal processing. Any known toning agent from thermography or photothermography may be used.

Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type within the scope of following general formula are described in GB-P 1,439,478 and U.S. Pat. No. 3,951,660:

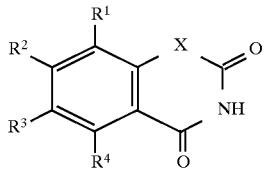

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring.

A toner compound, according to the above general formula, particularly suited for use in combination with polyhydroxy benzene reducing agents is benzo[e][1,3] oxazine-2,4-dione.

Stabilizers and Antifoggants

In order to obtain improved shelf-life and reduced fogging, stabilizers and antifoggants may be incorporated into the thermographic and photothermographic materials of the present invention. Examples of suitable stabilizers and antifoggants and their precursors, which can be used alone or in combination, include the thiazolium salts described in U.S. Pat. No. 2,131,038 and 2,694,716; the azaindenes described in U.S. Pat. No. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. No. 2,566,263 and 2,597,915; the tetrazolyl-thio-compounds described in U.S. Pat. No. 3,700,457; the mesoionic 1,2,4triazolium-3-thiolate stablizer precursors described in U.S. Pat. No. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Other Ingredients

In addition to said ingredients the thermographic material may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Ö1 A (tradename of BAYER AG—GERMANY), ultraviolet light absorbing compounds, white light reflecting and/or ultraviolet radiation reflecting pigments, silica, and/or optical brightening agents.

Support

The support for the thermographic material according to the present invention may be transparent, translucent or opaque and is preferably a thin flexible carrier made e.g. from paper, polyethylene coated paper or transparent resin film, e.g made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition, e.g. polyethylene terephthalate opacified by means of pigments and/or micro-voids, and/or may be coated with an opaque pigment-binder layer, and may be called synthetic paper, or paperlike film. Information about such supports can be found in EP's 194 106 and 234 563 and U.S. Pat. Nos. 3,944,699, 4,187,113, 4,780,402 and 5,059,579.

Protective Layer

A protective layer may also be provided for the thermographic or photothermographic recording layers. In general this protects the recording layers from atmospheric humidity and from surface damage by scratching etc. and prevents direct contact of printheads or heat sources with said recording layers. Protective layers for thermographic or photothermographic materials which come into contact with and have to be transported past a heat source under pressure, have to exhibit resistance to local deformation and good slipping characteristics during transport past the heat source during heating. Such a coating may have the same composition as an anti-sticking coating or slipping layer which is applied to thermal dye transfer materials at the rear side of the dye donor material.

A slipping layer, being said outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layer compositions are described, for example, in EP 138483, EP 227090, U.S. Pat. No. 4,567,113, U.S. Pat. No. 4,572,860, U.S. Pat. No. 4,717,711 and EP-A 311841.

A suitable outermost slipping layer comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Another suitable outermost slipping layer may be obtained by coating a solution of at least one silicon compound or a substance capable of forming during the coating procedure a polymer having an inorganic backbone which is an oxide of a group IVa or IVb element as described in EP-B 554 583.

Other suitable protective layer compositions that may be applied as slipping (anti-stick) coating are described e.g. EP-A 501 072 and EP-A 492 411.

Coating Techniques

The coating of any layer of the thermographic and photothermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

As described in "Handbook of Imaging Materials", edited by Arthur S. Diamond—Diamond Research Corporation—Ventura, Calif., published by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300° to 400° C. and the heating time per picture element (pixel) may be less than 1.0 ms, the pressure contact of the thermal printhead with the recording material being e.g. 200–500 g/cm$^2$ to ensure a good transfer of heat. Suitable thermal printing heads are e.g. a Fujitsu Thermal Head (FTP-040 MCS001), a TDK Thermal Head F415 HH7-1089 and a Rohm Thermal Head KE 2008-F3.

In order to avoid direct contact of the thermal printing heads with a recording layer not provided with an outermost protective layer, the imagewise heating of the recording layer with said thermal printing heads may proceed through a contacting but removable resin sheet or web wherefrom during said heating no transfer of recording material can take place.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power.

EP-A 654 355 describes a method for making an image by image-wise heating by means of a thermal head having energizable heating elements, wherein the activation of the heating elements is executed duty cycled pulsewise.

When used in thermographic recording operating with thermal printheads said thermographic materials are not suitable for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with a duty cycle Δ representing the ratio of activation time to total line time in such a way that the following equation is satisfied:

$$P \leq P_{max} = 3.3\ \mathrm{W/mm^2} + (9.5\ \mathrm{W/mm^2} \times \Delta)$$

wherein $P_{max}$ is the maximal value over all the heating elements of the time averaged power density P (expressed in W/mm$^2$) dissipated by a heating element during a line time.

Image-wise heating of the thermographic material can also be carried out using an electrically resistive ribbon incorporated into said material, consisting e.g. of a multi-layered structure in which a carbon-loaded polycarbonate is coated with a thin aluminium film (ref. Progress in Basic Principles of Imaging Systems—Proceedings of the International Congress of Photographic Science Köln (Cologne), 1986 ed. by Friedrich Granzer and Erik Moisar—Friedr. Vieweg & Sohn—Braunschweig/Wiesbaden, FIG. 6. p. 622). Current is injected into the resistive ribbon by electrically addressing a printing head electrode contacting the carbon-loaded substrate, thus resulting in highly localized heating of the ribbon beneath the energized electrode. The aluminium film may make direct contact with the heat-sensitive recording layer or its protective outermost layer.

The fact that in using a resistive ribbon thermographic material heat is generated directly in the resistive ribbon and only the travelling ribbon gets hot (not the print heads) an inherent advantage in printing speed is obtained. In the thermal printing head technology the various elements of the thermal printing head become hot and must cool down before the head can print without cross-talk in a next position.

Image-or pattern-wise heating of the thermographic material may also proceed by means of pixelwise modulated ultra-sound, using e.g. an ultrasonic pixel printer as described e.g. in U.S. Pat. No. 4,908,631.

Direct thermal imaging can be used for both the production of transparencies and reflection type prints. For such applications the support will be transparent or opaque, e.g. having a white light reflecting aspect. For example, a paper base substrate is present which may contain white reflecting pigments, optionally also applied in an interlayer between the recording material and said paper base substrate. Should a transparent base be used, said base may be colourless or coloured, e.g. with a blue colour.

Photothermographic Printing

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

In the hard copy field recording materials on a white opaque base are used, whereas in the medical diagnostic field black-imaged transparencies are widely used in inspection techniques operating with a light box.

The following examples and comparative examples illustrate the present invention. The percentages and ratios used in the examples are by weight unless otherwise indicated.

INVENTION EXAMPLE 1

A sodium behenate solution was prepared by first dissolving 34 kg of behenic acid in 340 L of isopropanol at 65° C. and then adding with stirring a 0.25N solution of sodium hydroxide until a solution pH of 8.7 was obtained. This required about 400 L of 0.25N NaOH. The concentration of the resulting solution was then adjusted to a sodium behenate concentration of 8.9% by weight and a concentration of isopropanol in the solvent mixture of 16.7% by volume, by a combination of evaporation and dilution.

The silver behenate synthesis was carried out at a constant UAg of 400 mV as follows: to a stirred solution of 30 g of gelatin (type 7598 from AGFA GELATINFABRIK vorm. KOEPFF & SOEHNE) in 750 mL of distilled water at 72° C. in a double walled reactor, several drops of a 2.94M aqueous solution of silver nitrate were added to adjust the UAg at the start of the reaction to 400 mV and then 374 mL of the sodium behenate solution, whose preparation is described above, at a temperature of 78° C. was metered into said reactor at a rate of 46.6 mL/min and simultaneously a 2.94M aqueous solution of silver nitrate was metered into said reactor, its addition rate being controlled by the quantity of said silver nitrate solution necessary to maintain a UAg of 400±5 mV in the dispersing medium in said reactor. Both the sodium behenate and silver nitrate solutions were added to the dispersing medium via small diameter tubes positioned just under the surface of said dispersing medium.

By the end of the addition step 0.092 moles of sodium behenate and 0.101 moles of silver nitrate had been added. The mixture was then stirred for a further 30 minutes.

Transmission electron micrographs of the resulting suspension, such as that at a magnification of 50,000× (1 cm=200 nm) in FIG. 1, showed that the suspension consisted, for the most part, of very fine particles, which are clearly not needle-shaped, having no obvious preferred growth direction, and have diameters of 40 to 60 nm.

The dispersion was coated at a temperature of 40° C., using a doctor blade coater with a slit-width of 120 μm, onto a subbed 100 μm thick polyester sheet. The dried layer was extremely transparent, exhibiting a haze value at a wavelength of 660 nm of 0.5% upon evaluation with a DIANO MATCHSCAN apparatus according to procedure B of the ASTM (American Society for Testing and Materials) standard D1003. Haze is defined as follows:

$$\text{Haze, \%} = \frac{\text{diffuse luminous transmittance} \times 100}{\text{total transmittance}}$$

where diffuse luminous transmittance is that transmittance which deviates from the direction of the incident beam by ≧2.5°.

COMPARATIVE EXAMPLE 1

State of the art preparation process for the silver salts of fatty acids as described, for example, by D. Kloosterboer in "Imaging Processes and Materials; Neblette's 8th edition", edited by J. Sturge, V. Walworth and A. Shepp, page 279, Van Nostrand (1989):

A sodium behenate solution was prepared by first dissolving 34 kg of behenic acid in 340 L of isopropanol at 65° C. and then adding with stirring a 0.25N solution of sodium hydroxide until a solution pH of 8.7 was obtained. This required about 400 L of 0.25N NaOH. A 0.4M aqueous solution of silver nitrate was then added slowly at 65° C. with stirring until a UAg of 340 mV was attained. In this process-step about 250 L of aqueous 0.4M $AgNO_3$ was added over a period of about 4 hours. The silver behenate precipitate was then filtered off and dried at 45° C. Upon redispersion in distilled water the sodium salt of a copolymer of styrene and maleic acid was used as the dispersing agent and the dispersion was ground in a ball mill to achieve the fine dispersion required for producing thermographic and photothermographic materials.

Transmission electron micrographs of the resulting dispersion, such as that with a magnification of 30,000× (1 cm=333 nm) in FIG. 2, showed that the dispersion consisted of particles with a very heterogeneous size distribution of needle-shaped particles with an length between 0.1 and 2 μm and a width between 0.1 and 0.4 μm.

After adding sufficient gelatin (type 7598 from AGFA GELATINFABRIK vorm. KOEPFF & SOEHNE) to the dispersion to obtain the same silver behenate and binder content in the emulsion as in that of INVENTION EXAMPLE 1, the dispersion was coated at a temperature of 40° C. using a doctor blade coater with a slit-width of 120 μm, onto a subbed 100 μm thick polyester sheet. The dried layer exhibited a haze value at a wavelength of 660 nm of 8.7% upon evaluation with a DIANO MATCHSCAN apparatus as described for INVENTION EXAMPLE 1 above.

This haze value is clearly inferior to that obtained with the dispersion of INVENTION EXAMPLE 1.

INVENTION EXAMPLE 2

A silver behenate dispersion was prepared as described in INVENTION EXAMPLE 1 in the absence of light. To this dispersion at 72° C. was added dropwise with stirring an aqueous solution 2.94 molar in halide, made up of 95% by weight of potassium bromide and 5% by weight of potassium iodide, until a UAg of 225 mV was attained. This process required 7.5 mL of said halide solution, whereby silver bromide and silver iodide were formed and the free silver ion concentration was strongly reduced. In this process some of the silver behenate may also have been converted into silver halide. After halide solution addition, the reaction mixture was stirred for a further 30 minutes at 72° C. The dispersion obtained after this step contained 0.079 moles of silver behenate and 0.022 moles of silver halide.

INVENTION EXAMPLE 3

A silver behenate dispersion was prepared as described in INVENTION EXAMPLE 1 in the absence of light. To this dispersion was added a separately prepared emulsion of 0.05 μm silver halide grains with the same halide composition and in the same quantity as that in the dispersion of INVENTION EXAMPLE 2.

INVENTION EXAMPLES 4 AND 5

0.014 g of succinimide was added to 10 g of each of the dispersions from INVENTION EXAMPLES 2 and 3 and the resulting dispersions were coated at a temperature of 40° C., using a doctor blade coater with a slit-width of 120 μm, onto a subbed 100 μm thick polyester sheet. After drying the layers were coated with a 2.3% aqueous solution of catechol using a doctor blade coater with a slit-width of 50 μm. After drying the resulting photothermographic materials, being INVENTION EXAMPLES 4 and 5 respectively, were exposed in contact with an AGFA DL 2000 UV lamp with a metal halogenide bulb type HPA 70GR through a test original and were then heated for 30 s at 85° C.

In the case of the photothermographic material of INVENTION EXAMPLE 4 produced using the dispersion of INVENTION EXAMPLE 2, a good quality image was obtained with a low fog density.

The photographic results with the photothermographic material of INVENTION EXAMPLE 5 produced using the dispersion of INVENTION EXAMPLE 3, on the other hand, were inferior with a higher fog density level than in the case of the photothermographic material of INVENTION EXAMPLE 4, with a lower concentration of free silver ions.

INVENTION EXAMPLE 6

A silver behenate/silver halide dispersion was prepared as described in INVENTION EXAMPLE 2 in the absence of light. This dispersion at a temperature of 45° C. was then circulated through a dialysis column (type HEMOFLOW F60, from FRESENIUS) and the conductivity of the removed washing water monitored. The initial conductivity of $5.41\times10^{-3}$ S/cm decreased to $6.7\times10^{-5}$ S/cm after removal of 2 L of washing water, which decreased further after further washing to $5.4\times10^{-5}$ S/cm, $4.1\times10^{-5}$ S/cm and $3.5\times10^{-5}$ S/cm after removal of 4 L, 5 L and 7 L of washing water respectively. After removal of 7 L of washing water, the free silver ion concentration was very low and the UAg of the dispersion had decreased to 209 mV.

Layers coated using this dispersion exhibited improved layer quality and improved mechanical properties.

INVENTION EXAMPLE 7

A silver behenate dispersion was prepared as described for INVENTION EXAMPLE 1, except that the dispersing medium used was a solution of 62 g gelatin (type 7598 from AGFA GELATINFABRIK vorm. KOEPFF & SOEHNE) in 1 L of distilled water instead of 30 g gelatin in 750 mL of distilled water; the addition rate of the sodium behenate solution was 8.3 mL/min instead of 46.6 mL/min; and the silver nitrate solution concentration was 0.246M instead of 2.94M. 0.092 moles of sodium behenate and 0.123 moles of silver nitrate were utilized in the reaction.

The shape and size of the silver behenate particles in the resulting dispersion were comparable to those of the silver behenate particles of INVENTION EXAMPLE 1. The transparency of layers produced with this dispersion was also comparable to that of layers produced with the dispersion of INVENTION EXAMPLE 1.

INVENTION EXAMPLE 8

A silver behenate dispersion was prepared as described for INVENTION EXAMPLE 7, except that the UAg of the dispersing medium was adjusted to a UAg of 380 mV at the start of the synthesis and was maintained at 380±5 mV instead of 400±5 mV during the synthesis, corresponding to a lower concentration of free silver ions.

Transmission electron micrographs of the resulting dispersion, such as that at a magnification of 50,000× (1 cm=200 nm) shown in FIG. 3, showed very fine needle-shaped particles 0.2 to 1 μm in length and 50 nm in width in addition to the non-needle-shaped particles with a diameter of 40 to 60 nm observed with in the dispersion of INVENTION EXAMPLE 1 (see FIG. 1). The needle-shaped particles observed were significantly smaller than those observed with the dispersion of COMPARATIVE EXAMPLE 1 (see FIG. 2).

INVENTION EXAMPLE 9

A silver behenate dispersion was prepared as described for INVENTION EXAMPLE 7, except that the UAg of the dispersing medium was adjusted to a UAg of 340 mV at the start of the synthesis and was maintained at 340±5 mV instead of 400±5 mV during the synthesis, corresponding to a lower concentration of free silver ions.

Visual inspection of the resulting dispersion compared with those of INVENTION EXAMPLES 1, 7 and 8, showed a clearly reduced transparency indicating an increased silver behenate particle size and hence that the UAg at which the synthesis is carried out has a significant influence upon particle size.

INVENTION EXAMPLE 10

A silver behenate dispersion was prepared as described for INVENTION EXAMPLE 1, except that the dispersing medium used was a solution of 40 g gelatin (type 7598 from AGFA GELATINFABRIK vorm. KOEPFF & SOEHNE) in 750 mL of distilled water instead of 30 g gelatin (type 7598 from AGFA GELATINFABRIK vorm. KOEPFF & SOEHNE) in 750 mL of distilled water; the addition rate of the sodium behenate solution was 8.3 mL/min instead of 46.6 mL/min; and the silver nitrate solution concentration was 0.246M instead of 2.94M. 0.092 moles of sodium behenate and 0.118 moles of silver nitrate were utilized in the reaction.

Visual inspection of the resulting dispersion and layers coated with the dispersion compared with those of INVENTION EXAMPLE 1, showed a similar transparency indicating a similar silver behenate particle size.

INVENTION EXAMPLE 11

A silver behenate dispersion was prepared as described for INVENTION EXAMPLE 1, except that the addition rate of the sodium behenate solution was 8.3 mL/min instead of 46.6 mL/min. 0.092 moles of sodium behenate and 0.120 moles of silver nitrate were utilized in the reaction.

Visual inspection of the resulting dispersion and layers coated with the dispersion compared with those of INVENTION EXAMPLE 1, showed a similar transparency indicating a similar silver behenate particle size.

INVENTION EXAMPLE 12

A silver behenate dispersion was prepared as described for INVENTION EXAMPLE 11, except that the gelatin used was type 10985 from S.B.I instead of type 7598 from AGFA GELATINFABRIK vorm. KOEPFF & SOEHNE; and 343 mL of the sodium behenate solution was added instead of 374 mL. 0.0843 moles of sodium behenate and 0.100 moles of silver nitrate were utilized in the reaction.

Visual inspection of the resulting dispersion and layers coated with the dispersion compared with those of INVENTION EXAMPLE 11, showed a similar transparency indicating a similar silver behenate particle size.

INVENTION EXAMPLE 13

A silver behenate dispersion was prepared as described for INVENTION EXAMPLE 1, except that 537 mL of the sodium behenate solution was added instead of 374 mL; and the addition rate of said sodium behenate solution was 114 mL/min instead of 46.6 mL/min. 0.132 moles of sodium behenate and 0.110 moles of silver nitrate were utilized in the reaction.

Visual inspection of the resulting dispersion and layers coated with the dispersion compared with those of INVENTION EXAMPLE 1, showed a similar transparency indicating a similar silver behenate particle size.

INVENTION EXAMPLE 14

A silver behenate dispersion was prepared as described for INVENTION EXAMPLE 1, except that the dispersing medium used was a solution of 25 g gelatin (type 7598 from AGFA GELATINFABRIK vorm. KOEPFF & SOEHNE) in 750 mL of distilled water instead of 30 g of type 7598 gelatin in 750 mL of distilled water; 467 mL of the sodium behenate solution was added instead of 374 mL; and the addition rate of said sodium behenate solution was 63 mL/min instead of 46.6 mL/min. 0.115 moles of sodium behenate and 0.117 moles of silver nitrate were utilized in the reaction.

Visual inspection of the resulting dispersion and layers coated with the dispersion compared with those of INVENTION EXAMPLE 1, showed a similar transparency indicating a similar silver behenate particle size.

INVENTION EXAMPLE 15

A silver behenate dispersion was prepared as described for INVENTION EXAMPLE 1, except that the dispersing medium used was a solution of 20 g gelatin (type 7598 from AGFA GELATINFABRIK vorm. KOEPFF & SOEHNE) in 750 mL of distilled water instead of 30 g of type 7598 gelatin in 750 mL of distilled water; and the addition rate of the sodium behenate solution was 8.3 mL/min instead of 46.6 mL/min. 0.092 moles of sodium behenate and 0.112 moles of silver nitrate were utilized in the reaction.

Visual inspection of the resulting dispersion and layers coated with the dispersion compared with those of INVENTION EXAMPLES 1, 10 and 11 showed a clearly reduced transparency indicating an increased silver behenate particle size and that the particle size is significantly affected by the quantity of gelatin in the dispersing medium as well as the UAg at which the synthesis is carried out.

INVENTION EXAMPLE 16

A silver behenate dispersion was prepared as described for INVENTION EXAMPLE 1, except that the dispersing medium used was a mixture of 200 mL of LEVASIL (TRADEMARK) VP AC 4055 (a 15% aqueous dispersion of colloidal silica produced by BAYER AG) and 550 mL of distilled water instead of 30 g of gelatin (type 7598 from AGFA GELATINFABRIK vorm. KOEPFF & SOEHNE) in 750 mL of distilled water. The quantities of sodium behenate and silver nitrate utilized in the reaction were not recorded.

Visual inspection of the resulting dispersion and layers coated with the dispersion compared with those of INVENTION EXAMPLE 1, showed a clearly reduced transparency indicating an increased silver behenate particle size and that the choice of dispersing agent used had influenced the silver behenate particle size obtained.

INVENTION EXAMPLE 17

A silver behenate suspension was prepared as described for INVENTION EXAMPLE 1, except that no dispersing agent was used in the dispersing medium, the dispersing medium consisting only of 750 mL of distilled water instead of 30 g of gelatin (type 7598 from AGFA GELATINPABRIK vorm. KOEPFF & SOEHNE) in 750 mL of distilled water; and the addition rate of the sodium behenate solution was 8.3 mL/min instead of 46.6 mL/min. The quantities of sodium behenate and silver nitrate utilized in the reaction were not recorded.

Visual inspection of the resulting suspension and layers coated with the suspension compared with those with the dispersion of INVENTION EXAMPLE 15, showed a clearly reduced transparency indicating an increased silver behenate particle size and that the presence of a dispersing agent in the suspending medium reduces the particle size of the silver behenate particles obtained.

INVENTION EXAMPLE 18

A silver behenate dispersion was prepared as described for INVENTION EXAMPLE 1, except that the dispersing medium used was a solution of 40 g of phthaloyl-gelatin in 750 mL of distilled water instead of 30 g gelatin (type 7598 from AGFA GELATINFABRIK vorm. KOEPFF & SOEHNE) in 750 mL of distilled water; and the addition rate of the sodium behenate solution was 32.3 mL/min instead of 46.6 mL/min. 0.092 moles of sodium behenate and 0.094 moles of silver nitrate were utilized in the reaction.

Visual inspection of the resulting dispersion and layers coated with the dispersion compared with those of INVENTION EXAMPLE 10, showed a clearly reduced transparency indicating an increased silver behenate particle size and that the choice of dispersing agent used had again influenced the silver behenate particle size obtained.

INVENTION EXAMPLE 19

A silver behenate dispersion was prepared as described for INVENTION EXAMPLE 1, except that the dispersing medium used was a solution of 29.4 g of gelatin (type 7598 from AGFA GELATINFABRIK vorm. KOEPFF & SOEHNE) in 731 mL of distilled water instead of 30 g of type 7598 gelatin in 750 mL of distilled water and in addition contained 18.7 g of a silver bromide-iodide emulsion with 0.7 g of gelatin and 5.03 g of silver bromide-iodide (consisting of 99.7 mol % of silver bromide and 0.3 mol % of silver iodide) with a particle size of 0.05 $\mu$m; the quantity of sodium behenate solution added was 358 mL instead of 374 mL; and the addition rate of said sodium behenate solution was 44.1 mL/min instead of 46.6 mL/min. 0.088 moles of sodium behenate were utilized in the reaction, but the quantity of silver nitrate used was not recorded. After the reaction was completed, the free silver ions present were converted into silver bromide by titrating the dispersion with a potassium bromide solution.

Visual inspection of the resulting dispersion and layers coated with the dispersion compared with those of INVENTION EXAMPLE 1, showed a similar transparency indicating a similar silver behenate particle size.

INVENTION EXAMPLE 20

0.014 g of succinimide was added to 10 g of the dispersion of INVENTION EXAMPLE 19 and the resulting dispersion was coated at a temperature of 40° C., using a doctor blade coater with a slit-width of 120 $\mu$m, onto a subbed 100 $\mu$m thick polyester sheet. After drying the layer was coated with a 2.3% aqueous solution of catechol using a doctor blade coater with a slit-width of 50 $\mu$m. After drying the resulting photothermographic material, was exposed in contact with an AGFA DL 2000 UV lamp with a metal halogenide bulb type HPA 70GR through a test original and were then heated for 30 s at 85° C. A good quality image was obtained with a low fog density.

Having described in detail preferred embodiments of the current invention, it will now be apparent to those skilled in the art that numerous modifications can be made therein without departing from the scope of the invention as defined in the following claims.

We claim:

1. A process for producing a suspension of particles containing a substantially light-insensitive silver salt of an organic carboxylic acid, comprising simultaneous metered addition of an aqueous solution or suspension of an organic carboxylic acid or its salt and an aqueous solution of a silver salt to an aqueous liquid, wherein said metered addition of said aqueous solution or suspension of said organic carboxylic acid or its salt and/or said aqueous solution of said silver salt is regulated by the concentration of silver ions or the concentration of anions of said silver salt in said aqueous liquid, wherein said aqueous liquid contains a dispersing agent for said particles, and wherein said dispersing agent is selected from the group consisting of a natural polymeric substance, a synthetic polymeric substance and a finely divided inorganic powder.

2. A process according to claim 1, further comprising the step of removing soluble salts produced during said process and any excess dissolved ions by on-line or off-line desalting.

3. A process according to claim 1, wherein said metered addition of said aqueous solution or suspension of said organic carboxylic acid or its salt and/or said silver salt aqueous solution to said aqueous liquid is regulated such that an excess of silver ions is present in said aqueous liquid during said production of said particles.

4. A process according to claim 1, wherein said metered addition of said aqueous solution or suspension of said organic carboxylic acid or its salt and/or said silver salt aqueous solution to said aqueous liquid is regulated such that an excess of silver ions is present in said aqueous liquid during said production of said particles, and wherein said regulated excess of silver ions during said production of said particles is achieved by maintaining the UAg of said aqueous liquid, defined as the potential difference between a silver electrode of $\geqq$99.99% purity in said aqueous liquid and a reference electrode consisting of a Ag/AgCl-electrode in 3M KCl solution at room temperature connected with said aqueous liquid via a salt bridge consisting of a 10% $KNO_3$ salt solution, at 70° C. at least 380 mV.

5. A process according to claim 1, wherein said metered addition of said aqueous solution or suspension of said organic carboxylic acid or its salt and/or said silver salt aqueous solution to said aqueous liquid is regulated such that an excess of silver ions is present in said aqueous liquid during said production of said particles, wherein said regulated excess of silver ions during said production of said particles is achieved by maintaining the UAg of said aqueous liquid, defined as the potential difference between a silver electrode of $\geqq$99.99% purity in said aqueous liquid and a reference electrode consisting of a Ag/AgCl-electrode in 3M KCl solution at room temperature connected with said aqueous liquid via a salt bridge consisting of a 10% $KNO_3$ salt solution, at 70° C. at least 380 mV, and wherein the UAg of said aqueous liquid is such that 80% of said particles have no preferred growth direction.

6. A process according to claim 1, wherein said metered addition of said aqueous solution or suspension of said organic carboxylic acid or its salt and/or said silver salt aqueous solution to said aqueous liquid is regulated such that an excess of silver ions is present in said aqueous liquid during said production of said particles, wherein said regulated excess of silver ions during said production of said particles is achieved by maintaining the UAg of said aqueous liquid, defined as the potential difference between a silver electrode of $\geqq$99.99% purity in said aqueous liquid and a reference electrode consisting of a Ag/AgCl-electrode in 3M KCl solution at room temperature connected with said aqueous liquid via a salt bridge consisting of a 10% $KNO_3$ salt solution, at 70° C. at least 380 mV, and wherein the UAg of said aqueous is such that 90% of said particles have a diameter $\leqq$60 nm.

7. A process according to claim 1, wherein said organic carboxylic acid is a fatty acid, and wherein said salt of an organic carboxylic acid is a salt of a fatty acid.

8. A process according to claim 1, wherein said organic carboxylic acid is a fatty acid, wherein said salt of an organic carboxylic acid is a salt of a fatty acid, and wherein said salt of a fatty acid is a salt of behenic acid.

9. A process according to claim 1, wherein, after completion of said production of said aqueous suspension of said particles, excess dissolved silver ions are converted into at least one silver salt.

10. A process according to claim 1, wherein, after completion of said production of said aqueous suspension of said particles, excess dissolved silver ions are converted into at least one silver salt, and wherein said silver salt is photosensitive.

11. A process according to claim 1, wherein said particles are produced in the presence of silver halide.

12. A process for producing a suspension of particles containing a substantially light-insensitive silver salt of an organic carboxylic acid, comprising simultaneous metered addition of an aqueous solution or suspension of an organic carboxylic acid or its salt and an aqueous solution of a silver salt to an aqueous liquid, wherein said metered addition of said aqueous solution or suspension of said organic carboxylic acid or its salt and/or said aqueous solution of said silver salt is regulated by the concentration of silver ions or the concentration of anions of said silver salt in said aqueous liquid, wherein said aqueous liquid contains a dispersing agent for said particles, wherein said dispersing agent is selected from the group consisting of a natural polymeric substance, a synthetic polymeric substance and a finely divided inorganic powder, and wherein said natural polymeric substance is gelatin or a modified gelatin.

* * * * *